US005647080A

United States Patent [19]

Martin

[11] Patent Number: 5,647,080

[45] Date of Patent: Jul. 15, 1997

[54] AX HAMMER

[76] Inventor: John Martin, 7308 Corbin Ave. Apt E, Reseda, Calif. 91335

[21] Appl. No.: 521,743

[22] Filed: Aug. 31, 1995

[51] Int. Cl.[6] ..... A47G 27/04

[52] U.S. Cl. ..... 7/103; 7/145; 81/20; 30/308.1

[58] Field of Search ..... 7/103, 145, 156; 81/20, 25; 30/308.1

[56] References Cited

U.S. PATENT DOCUMENTS

| | | | |
|---|---|---|---|
| 1,252,903 | 7/1918 | Hight | 30/308.1 X |
| 1,526,251 | 2/1925 | Squier | 30/308.1 |
| 3,233,643 | 2/1966 | Reuterfors | 7/145 X |
| 3,745,598 | 7/1973 | Krell | 81/25 X |
| 4,433,709 | 2/1984 | Porter | 30/308.1 X |

*Primary Examiner*—James G. Smith
*Attorney, Agent, or Firm*—Frank L. Zugelter

[57] ABSTRACT

An ax hammer (10) for use in carpet laying, including a head (11) having a base (19) on which a hammering surface (20) is mounted at the one extremity of head (11), and a blade (30) disposed at the head's other extremity. A lowermost niche or hollow (241) at the bottom of the base (19) extends circumferentially there-around, more deep cut to provide for a finger or the like, than the niches (24) that are above it at the top of the head (11). An elongated arcuate niche (31) extends from about the tool's bore (17) formation towards the tool's other extremity, terminating at an inverted curved configuration (37) adjacent such other extremity. Sunken pockets (27, 40) are provided respectively adjoining the niches (241, 31) while sunken pockets 41 are included along the top wall (25) of the head (11). The niche (31) extends to below the bottom of the body formation for bore (17) to provide a deeper dimension to the other extremity and its blade (30) and for insertion of a portion of the user's hand. Rounded corners (44) are provided for the pockets (27, 40, 41).

28 Claims, 2 Drawing Sheets

AX HAMMER

TECHNICAL FIELD

This invention relates to carpet laying tools, and in particular, is directed to a tool or ax hammer that attaches a tack strip to the floor and tucks the rug being laid to specific locations in the specified area in which it is to be laid and held.

BACKGROUND OF THE INVENTION

Ax hammers are used by carpet installers for attaching carpets to a tact strip already secured to a floor, during the carpet laying process. With the introduction of new types of carpets and carpet backings presently in use, now available in the market-place, the old fashioned ax hammers have become undesirable to use as they are not satisfactory or very effective in doing the job.

The form, shape, and features of the ax hammer of this invention eliminates the physical stress put on the carpet layer's joints by every day use of all the other tools on the market today. A thirty-two [32] oz. hammer ergonomically made in accordance with this invention is designed specifically for use in the carpet trade.

One of today's known tools is disclosed in U.S. Pat. No. 3,745,598, granted Jul. 17, 1973.

The features incorporated in the subject matter of this invention provides for an efficient and superior laying of a carpet to conform or restrain it to its locations in the area over which it is to be laid, provides for efficiency in the action or work of the tool in the carpet laying process, and provides for a substantial amount of, if not all, elimination of the noted physical maladies.

SUMMARY OF THE INVENTION

The subject matter of the invention in the tool or ax hammer includes a hatchet-like or ax-like head but with distinctly different or novel features incorporated therein than found in known hatchets and axes. The ax hammer comprises a member or head made preferably of metal preferably cast, and which includes a bore into which the tang of a handle securely fits. The head includes a body extending to its one extremity and to one side of the bore or tang's axis and which body forms a base, preferably cylindrical, for a hammering surface that provides the necessary blows to the carpet being laid and/or attached to the tack strip. As the head extends away from the axis of the bore or handle's tang in one direction, in the opposite direction it tapers in an elongated manner to its other extremity at which a cutting blade for cutting carpet terminates such extremity. The body formation for the bore is generally disposed between the bottom of the base for the hammering surface and the tapering portion of the body of the head and includes in the head thick portions for weightiness in such body formation. Arcuate hollows or niches are located about the bottom of the base of the hammering surface and located along the top of the head at the base. The hollow or niche at the bottom of the head effectively accommodates the fingers of the hand grasping the tool during one of its working uses. An elongated arcuate hollow or niche is formed along the bottom of the head, beginning generally midway of the bore and extending in the direction of the extremity at which the blade is disposed, to effectively accommodate the back of the hand grasping the tool in another mode of working use.

A first set of pockets are symmetrically disposed in or sunk into the head at the bottom location of the noted arcuate hollow or niche, i.e., along both exterior walls forming the sides of the head and forming the base and which circumferentially extend through the thickness of the head and between such exterior walls and base.

Another or second set of symmetrically disposed or sunken pockets in the head flow with (i.e., are adjoining to) and in the direction of the elongated hollow or niche towards the blade's extremity, however, the termini for these noted pockets lie proximate to or fall short of the blade or its associated extremity. The same is true for the terminus of the elongated arcuate hollow or niche, however, before the elongated hollow or niche reaches its terminus, it extends to below the lowest point of the body formation for the bore so as to provide a deeper or broader length of body for such extremity's blade. An inverted curved configuration in the head joins the terminus of the elongated hollow or niche to the extremity below the lowest point of the cutting blade on the extremity.

Another or third set of symmetrically disposed sunken pockets, each including an elongated dimension, is disposed or located along the top wall of the head and draws out portions of the head itself, beginning generally in the vicinity of the axis of the bore or tang and extending in a direction towards the blade's disposition. Rounded edges or corners are elsewhere provided in the makeup of the head so as to prevent sharp points or lengths that would injure the user of the ax hammer while also removing an element of damage that could occur to wood and the like during use of the tool.

In addition, these features contribute substantially to the elimination, prevention, minimizing, or reduction of physical stresses in hand, wrist, arm and shoulders that heretofore have been the bane of carpet laying personnel at the end of the working day or other periods of work, as the grasping of the tool by some of the above noted features provide such reliefs.

An object of this invention is to provide a novel carpet laying tool.

Another object of this invention is to provide for a better hold or grip on a carpet laying tool and thereby ensuring an efficient working of the tool on a carpet being installed to conform to its defined area.

A still further object of the invention is to prevent scuffing of a baseboard and the like by the contact of the ax hammer therewith.

A still further object of this invention is to reduce or eliminate physical stresses that otherwise arise after a day's and longer periods of labor of laying carpets and which have materialized in the past with the use of known carpet laying tools.

A further object of the invention is to lay a carpet that will conform or restrain itself to the area for which it has been laid out.

These and other objects and advantages of the invention will become more apparent from a full and complete reading of the following description, the appended claims thereto, and the accompanying drawing comprising two (2) sheets of eight (8) FIGURES.

PREFERRED MODE OF CARRYING OUT THE INVENTION

Figure 1:
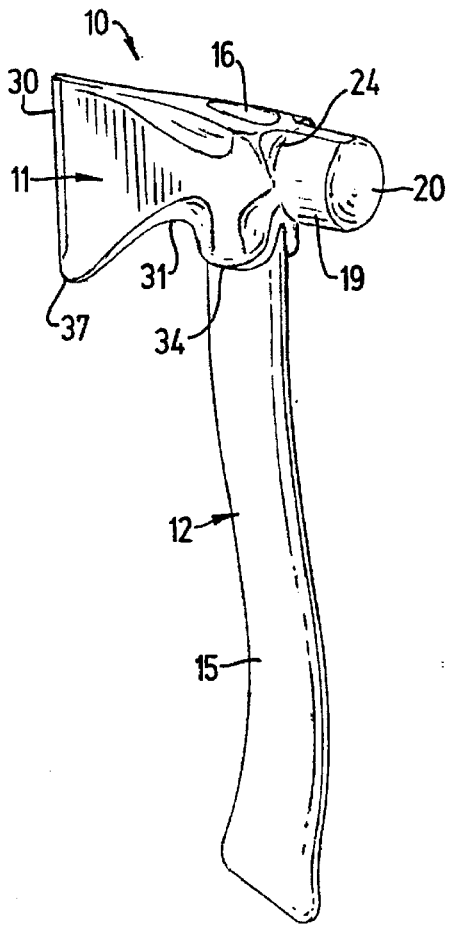
FIG. 1 is a perspective view of the subject matter of this invention.
Figure 7:
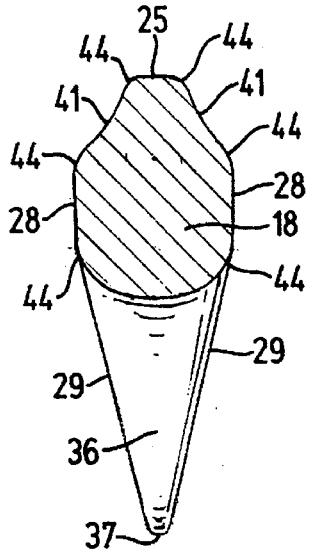
FIG. 7 is a view taken on line 7—7 of FIG. 5.

Referring now to the drawing wherein reference characters correspond to like numerals following in the description hereinafter, FIG. 1 illustrates the tool or ax hammer 10 that is the subject matter of the instant invention. The ax hammer 10 comprises a unitary head or member 11 securely mounted upon a handle 12 of a size suitable for a hand 13, FIGS. 2 and 3, to grasp as the tool is working upon a carpet 14, FIGS. 2 and 3. The handle 12 is made preferably of hard wood and finished, fabricated into the form of a shank 15 configured as desired and for long lasting application to the job of carpet laying by hand 13. The shank 15 includes a tang 16, FIGS. 1, 4, at or near its one end for insertion into a complementing bore 17, FIG. 5, formed in a thickness 18, FIG. 7, in the head 11, the tang 16 being dimensioned to tightly adhere to the thickened body formation forming the bore 17, whereby the head 11 and handle 12 do not part from one another in use (or otherwise) of the tool 10. In the illustrated drawing, the tang's cross-sectional structure is shown generally as an oval configuration. The handle 12 is of a suitable length for carrying and using the tool.

In one direction in the head 11, a base 19 is integrally mounted adjacent to the body formation forming bore 17 and on which a hammering surface 20, slightly rounded, and preferably smooth, and is mounted and disposed at the one extremity for head 11. The base 19 comprises a cylindrical or rounded body 21, of a desired length, and includes smooth walled surfaces. The base 19 includes a bottom 22 at which, along or adjacent to, arcuate hollows or niches 24 are formed thereabout, FIGS. 1, 3, 5. The lowermost hollow or niche 241 is of a deeper cut than the upper and much smaller hollows 24, FIGS. 1, 5, 6, observed along the top wall 25 of the head 11, and is at least of a size and circumferential length extending along the underside of the head 11 as observed in FIG. 5, terminating generally within the confines of the base 19 itself at its one end and terminating at its other end generally at a point in the head at which the thickness 18, in which the bore 17 is formed, is disposed, whereby the forefinger 26 of the hand 13, FIG. 2, of the person grasping and using the tool 10 in the laying of carpet 14 can be inserted.

A first set of pockets 27 are symmetrically disposed in or sunk into the head 11 at the bottom location of the noted arcuate hollow or niche 241, i.e., they extend along the length of the head 11 beginning generally within the confines of the base 19 and progress to within the thickness of the body formation forming the bore 17 in the head, thus being carved out of a portion of the exterior walls 28 and the base 19. Pockets 27 circumferentially extend through the thickness of the head 11 and between such exterior walls 28 and base 19. These pockets provide for facile employment of a forefinger 26 or other portion of hand 13 as well as providing for variation sought in the weight of the tool 10.

Figure 8:
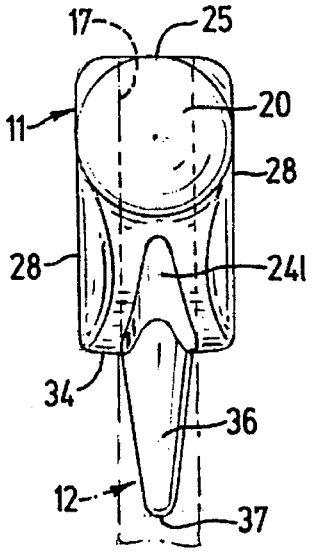
FIG. 8 is a view taken from the end of the tool at which the hose is located, with the accompanying portion of the handle shown in phantom.

Turning to the head 11 as it flows from the bottom 22 of the base 19 towards and along or at the thickness 18 that provides for the body formation for the bore 17, its exterior walls 28 begin to taper, taper 29 continuing towards the head's other extremity at which a blade or cutting edge 30 is disposed. In the lower half of the head 11, as its tapering body flows from its beginning towards the extremity at which is disposed the blade 30, an elongated hollow or niche 31 is formed generally at or along a central plane 32, FIG. 5, of the head 11. Hollow 31 begins at the lowest point 34 of the body formation for the bore 17, and continues to extend in the direction of blade 30's extremity. The body line 36 FIG. 7, for hollow 31 begins at point 34 and ends at an inverted curved configuration 37 disposed immediately adjacent or contiguous to the extremity in which the blade 30 is located. The body line 36 in its path between its ends extends upwardly from the lowest point 34 in a direction towards the top wall 25, FIGS. 4, 7, 8, before it turns curvilinearly downwardly to the inverted curved configuration 37. It is to be observed thereby that a deeper or longer dimension for blade 30 is provided by this continuing length for the body line 36.

Another set of symmetrically disposed or sunken pockets 40 in the head 11 flow with (i.e., are adjoining to) and in the direction of the elongated hollow or niche 31 towards the blade's extremity. These pockets 40 begin at their one end generally at the same location as the elongated niche 31, in the thickness 18 about the bore 17, and terminate at their other end generally with the termination of the elongated niche 31 at the inverted curved configuration 37, i.e., proximate to or falling short of the blade or its associated extremity.

Figure 4:
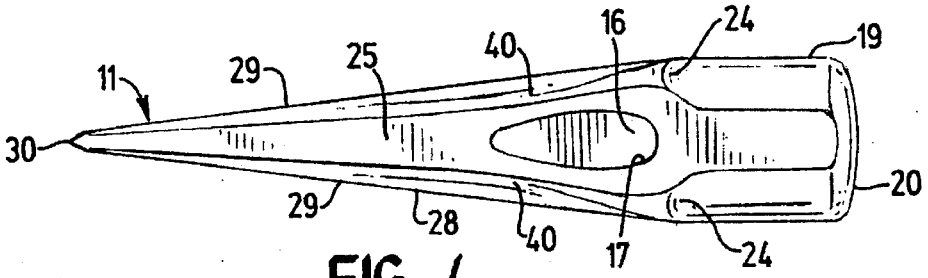
FIG. 4 is a top view of the tool.
Figure 5:
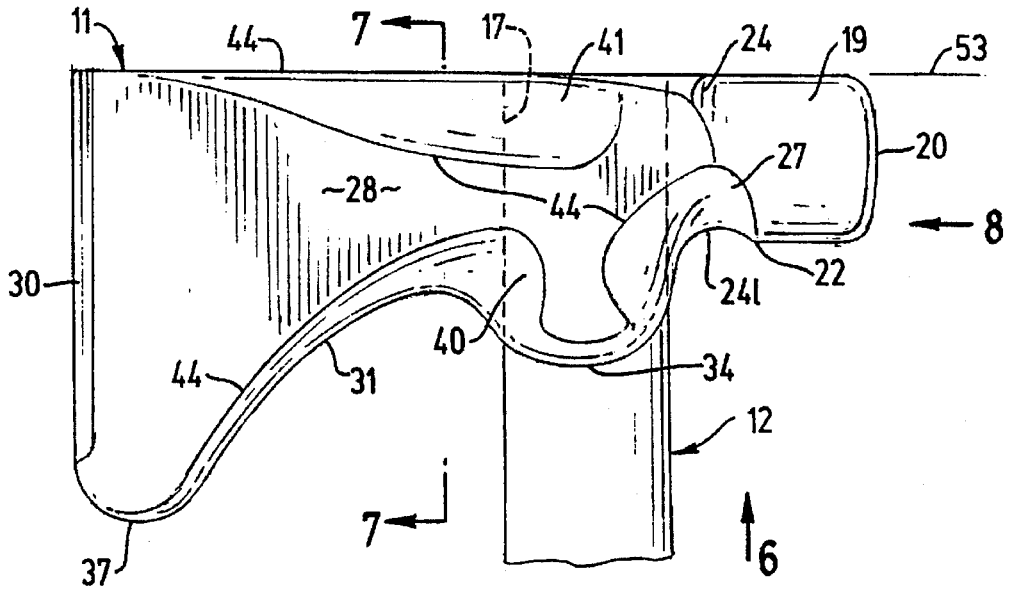
FIG. 5 is an elevational view of a fragmentary portion of the handle and the head mounted at its upper end.
Figure 6:
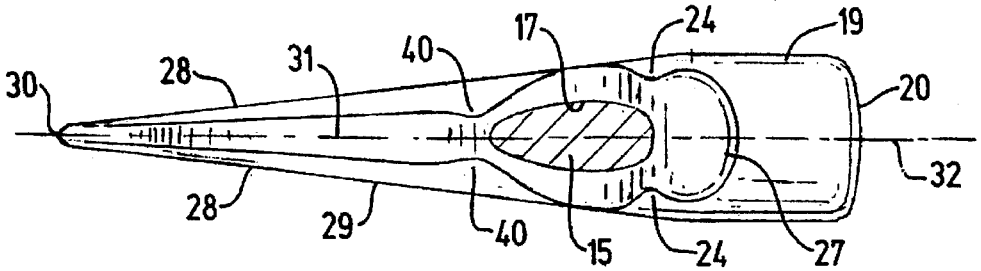
FIG. 6 is a view taken in the direction of the arrow 6 in FIG. 5.

Along the taper 29 of head 11, an elongated sunken pocket 41 is located to each side of the central plane 32, FIGS. 4, 6, of the head 11, and along its top wall 25. The pockets 41 begin within the thickness 18 coincident to or aligned with the axial dimension of the body formation of the bore 17 and extend toward the extremity at which blade 30 is disposed, the greatest depth of each elongated pocket 41 being disposed generally within the confines of the dimension for bore 17 and slowly receding in its depth as it approaches such extremity, terminating at the top wall 25 short of or proximate to such extremity, FIG. 5.

Tool 10 is substantially a heavy one, particularly in its head 11, so that the necessary force, for either tucking carpet or cutting a tuck strip, is available to the user. The base 19 preferably includes a diameter the size of which is best equated to the widest thickness of the ax head 11, FIG. 6, and at which its taper usually begins. The length and depths (height) of the ax head 11 between its two extremities and along its cutting edge 30 and tapering exterior walls 28 are capable of different degrees of length and depths (height), depending on the amount of weight desired in a given fabrication of the head 11 and the overall size for the ax hammer 10. Consequently, or taking into consideration a desired weight for the tool 10, the hollow or niches 24, 241, and 31 and/or the sunken pockets 27, 40, 41, all or one or a combination of them, may be volumetrically and/or congruously changed in order to contribute to the determination of a desired weight that provides the desired forcefulness that accompanies the efficient laying of carpet 14. The kind of wood for the handle 12, having its own weight, also contributes to a desired weight for the tool 10.

in use, as the handle 12 of the tool 10 is grasped by one hand 13 to use the hammering surface 20, the back of the hand is comfortably positioned, FIG. 2, within the elongated hollow 31, while the hand's forefinger 26, FIG. 2, encircles in a curling fashion the handle 12 below its tang 16 and in the arcuate hollow 241 in the vicinity of the bottom of the hammering surface's base 19, both back and forefinger melting into their respective hollows and pockets if included with the hollows in the tool, all of which provides an effective hold on the tool while its hammering surface 20 works. As the handle 12 of the tool is grasped by the hand to use the cutting edge 30 of the head or member 11, the web between forefinger and thumb seats comfortably in the smaller hollow or niche 241 behind or under the base 19 while the back of the hand seats comfortably in the larger hollow or niche 31.

Softly rounded corners, as at the edges 44 of the pockets 27, 40, 41, are provided to prevent scuffing of baseboard, wooden and other surfaces juxtaposed to the area of working the tool on the carpet, as well as not possibly injuring the user by any sharpness that otherwise would be in the tool.

Figure 2:
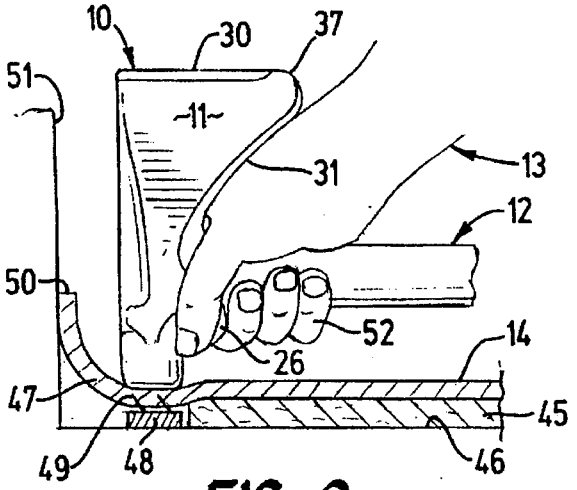
FIG. 2 is a side view of the tool at work upon a carpet that is being tacked in place on a flooring, the carpet, tack strip and carpet backing shown in cross-section.

Applying the tool or ax hammer 10 to a rug or carpet 14, FIG. 2 with the hand 13 of the carpet 14 laying personnel grasping the shank 15 of the handle 12 in a manner that disposes the back of the hand 13 into the elongated or larger hollow or niche 31 while the forefinger 26 of the same hand 13 encircles or disposes itself within the smaller hollow or niche 241, the hammering surface 20 is in a position to offer itself to and along the upper surface of the carpet 14 mounted on a pre-disposed backing 45 on a flooring 46, a marginal portion 47 of the carpet 14 also overlying its tack strip 48. The marginal portion 47 of carpet 14 is being applied to its tack strip 48 and therealong and to which the blows from the hammering surface 22 attaches the carpet to a series of spaced inclined pins 49, already fabricated into the length of and within the tack strip 48 which already has been secured (not shown) to flooring 46. FIG. 2 illustrates the hammering surface 22 of the hammer head 19 in its blow upon a carpet 14 and over the tack strip 48, to attach the rubbed carpet's material to the pins 49, to thereby secure the carpet 14 to its conformed area of laying. The carpet 14 had already been prepared to conform to its area in which it is to be laid and fastened along its length to one or more of such tack strips 48 already securely mounted to the flooring 46. In such preparation, the carpet had been laid directly upon its backing 45 on the flooring 46 in the area in which the carpet 14 is to conform, and thereafter, the carpet 14 had been stretched across the backing 45 and the flooring 46 by a stretching device otherwise known in the carpet laying trade. It now is time to tack the carpet 14 to the tack strip or strips 48, this being illustrated by FIG. 2.

Figure 3:
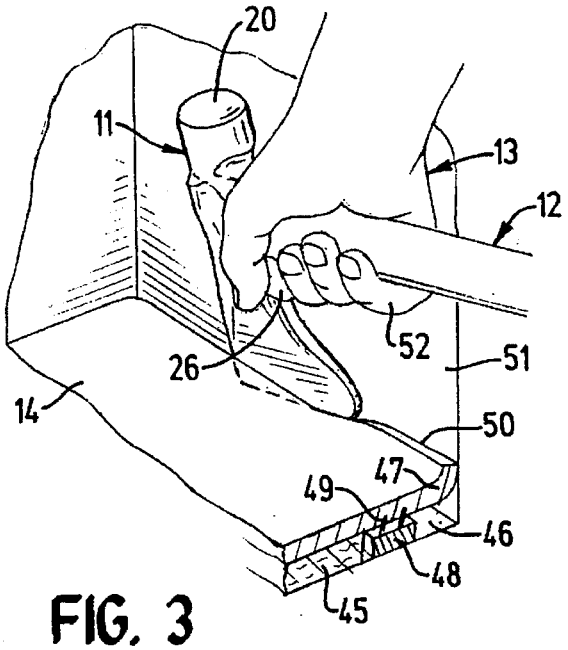
FIG. 3 is an oblique view of the tool, continuing further or other work illustrated in FIG. 2, by compressing the edge of the carpet downwardly at the wall adjoining the tack strip.

FIGS. 2 and 3 illustrate the implanting of the carpet 14's edge 50 along a room wall 51 or the like, after tucking of carpet 14 between wall 51 and the tack strip 48 has been accomplished. It is to be noted that room wall 51 as seen in FIG. 2 is also considered a riser on a stairway and to which the invention and its operation is applicable.

The carpet 14 laying personnel reverses the positions of hammer head 19 and cutting edge 30 of the tool in the grasping hand 13 for the tool so that the web [not shown] between thumb and forefinger now engages the smaller hollow or niche 241, FIG. 3, while the extremities of the forefinger encircles the shank 15 of the handle 12 while seated within or contiguous to the elongated or larger hollow or niche 31 in the member 11. The cutting edge 30 now is ready to function, by means of wrist action by the carpet laying personnel jamming the cutting edge 30 up and down as it is moved along the carpet 14's edge 50 and wall 51, to implant the edge 50, as illustrated in FIG. 3, and as observed atop the ax hammer 10 itself, thus illustrating the completed work on the edge 50 of the carpet 14, and to continue jamming the cutting edge 30 up and down on the uncompleted work, illustrated in FIG. 3 by the exposed edge 50 of the carpet 14 below the little finger 52 of the hand 13.

In assembly a fabricated shank 15 for the handle 12 and the fabricated member 11 are fastened to each other by means of shaping the tang 16 of the handle 12 to be congruous with the bore 17 within the member 11 and inserting it into such bore 17, to be firmly secured therein, all done in a conventional manner as is in the assembly of hammers and the like.

The handle 12 is made of hardwood, or other suitable material. The member 11 is cast in a unitary manner, in accordance with known casting processes and techniques, stainless steel being the preferred fabricated material.

Various changes and modifications to the subject matter of the invention may be had, without departing from the scope and spirit of the invention as set out in the appended claims hereto. For example, the small hollow or niche 241 is shown, FIG. 5, can be shifted to-or-fro longitudinally of the member 11 as the latter is formed, with repositioning of pockets 27 accordingly when included. One or both sunken pockets or recesses 41 need not be measured from the upper wall 25 but may take place within the interior pattern or area of a wall or walls 28. The tangential line 53, FIG. 5, of base 19, illustrated in the drawing as being in the same plane as top wall 25, need not necessarily be limited to lying in such plane. The weight of the tool 10 is changeable or varied by reason of a desired selection of thicknesses for the tapering walls 28, the base 19, and the choice of wood for the handle, to provide the weight that is effective in efficiently laying a carpet. Each of the pairs of pockets 27, 40, 41, in each of their respective sets, preferably are formed symmetrically, with one or the other of a pair being optionally omittable, and are congruous to one another in their own respective pair in the preferred embodiment of the invention. Either one or or both of the two pockets 40 need not meet at the body line 36, nor is one or both of pockets 41 have to adjoin the top wall 25. Also, the taper along exterior walls 28 can be limited to tapering of just one of them and still provide for the formation of blade 30.

INDUSTRIAL APPLICABILITY

The tool is useful in the carpet and carpet laying industry.

I claim:

1. In an ax hammer having a head with exterior walls, said head having a hammering surface at its one extremity the hammering surface mounted on a base, the head having a taper in one or both of its exterior walls that extends towards its other extremity at which a blade is mounted, the head having a bottom including an underside and a top, and a body formation between the one extremity and the other extremity forming a bore for securely mounting a tang of a handle therein, the improvement comprising the exterior walls in said head and between its top and bottom tapering from a location proximate to said body formation and towards the other extremity, the base for the hammering surface disposed between the hammering surface and the bore, one or more arcuate hollows disposed between the base and the bore at the top of the head and a lowermost arcuate hollow disposed at the bottom of the head between the base and the bore, said lowermost hollow being of a deeper cut than the one or more arcuate hollows at the top of the head and of a size and circumferential length extending along the underside of the head for providing insertion of a portion of a hand of the user of the ax hammer, a first set of sunken pockets in said head and adjoining said lowermost arcuate hollow, an elongated hollow disposed along the bottom of the head and between said body formation and the other extremity, a second set of sunken pockets in said head and adjoining said elongated hollow, an inverted curved configuration along the bottom of the head and disposed adjacent the other extremity, said elongated hollow terminating at said configuration, said elongated hollow extending to below said body formation at the bottom of the head so as to provide a deeper body in the head for its blade, and a third set of sunken pockets disposed along the top of the head and extending between said body formation and the other extremity of the head.

2. The improvement of claim 1 wherein said pockets include rounded corners.

3. In an ax hammer having a head with exterior walls and extremities, said head having a hammering surface at one of its extremities the hammering surface mounted on a base, the head having a taper in one or both of its exterior walls and which extends towards the other of its extremities at which a blade is mounted, the head having a bottom including an under-side and a top and a body formation between the one of its extremities and the other of its extremities forming a bore for securely mounting a tang of a handle therein, the improvement comprising the other of its extremities and its blade having dimensions greater than that of the base, a lowermost arcuate hollow disposed at the bottom of the head and extending between and into the base and into the body formation for the bore, said lowermost arcuate hollow being of a deep cut and of a size and circumferential length extending along and around the underside of the head for providing insertion of a portion of a hand of the user of the ax hammer.

4. The improvement of claim 3 including a set of sunken pockets in said head and adjoining said lowermost arcuate hollow.

5. The improvement of claim 4 wherein one or more of said pockets adjoining said lowermost arcuate hollow have rounded corners.

6. The improvement of claim 3 including an elongated hollow disposed along the bottom of the head and between the said body formation and its other extremity.

7. The improvement of claim 6 including and inverted curved configuration along the bottom of the head and disposed adjacent its other extremity, said elongated hollow terminating at said configuration.

8. The improvement of claim 6 wherein said elongated hollow is arcuate.

9. The improvement of claim 6 including a set of sunken pockets disposed in said head along its top and generally located between said body formation and its other extremity.

10. The improvement of claim 9 wherein one or more of said pockets along the head's top have rounded corners.

11. The improvement of claim 6 including a set of sunken pockets in said head and adjoining said elongated hollow.

12. The improvement of claim 11 wherein one or more of said pockets adjoining said elongated hollow have rounded corners.

13. The improvement of claim 12 wherein said elongated hollow is arcuate.

14. The improvement of claim 7 wherein said elongated hollow is arcuate.

15. The improvement of claim 6 wherein said elongated hollow extends to below the said body formation at the bottom of the head so as to provide a deeper body in the head for its blade.

16. The improvement of claim 15 including a set of sunken pockets in said head and adjoining said elongated hollow.

17. The improvement of claim 15 including a set of sunken pockets disposed in said head along its top and generally located between said body formation and its other extremity.

18. The improvement of claim 15 wherein said elongated hollow is arcuate.

19. In an ax hammer having a head with exterior walls and extremities, said head having a hammering surface at one of its extremities the hammering surface mounted on a base, the head having a taper in one or both of its exterior walls and which extends towards the other of its extremities at which a blade is mounted, the head having a bottom including an under-side and a top and a body formation between the one of its extremities and the other of its extremities forming a bore for securely mounting a tang of a handle therein, the improvement comprising the other of its extremities and its blade having dimensions greater than that of the base, and an elongated hollow disposed along the bottom of the head and within the exterior walls and within the body formation for the bore and extending from its disposition in such body formation and exterior walls towards the other of its extremities.

20. The improvement of claim 19 wherein said elongated hollow is arcuate.

21. The improvement of claim 20 including a set of sunken pockets in said head and adjoining said elongated hollow.

22. The improvement of claim 21 wherein one or more of said pockets adjoining said elongated hollow have rounded corners.

23. The improvement of claim 19 including an inverted curved configuration along the bottom of the head and disposed adjacent its other extremity, said elongated hollow terminating at said configuration.

24. The improvement of claim 23 wherein said elongated hollow is arcuate.

25. The improvement of claim 19 wherein said elongated hollow extends to below said body formation at the bottom of the head so as to provide a deeper body in the head for its blade.

26. The improvement of claim 25 wherein said elongated hollow is arcuate.

27. The improvement of claim 25 including an inverted curved configuration along the bottom of the head and disposed adjacent its other extremity, said elongated hollow terminating at said configuration.

28. The improvement of claim 27 wherein said elongated hollow is arcuate.

* * * * *